US009393773B2

(12) United States Patent
Hoffman, Jr. et al.

(10) Patent No.: US 9,393,773 B2
(45) Date of Patent: Jul. 19, 2016

(54) MODULAR OVAL SCREEN PRINTING APPARATUS

(75) Inventors: Richard C. Hoffman, Jr., Lake Forest, IL (US); Boguslaw Biel, Carol Stream, IL (US)

(73) Assignee: M&R Printing Equipment, Inc., Glen Ellyn, IL (US)

( * ) Notice: Subject to any disclaimer, the term of this patent is extended or adjusted under 35 U.S.C. 154(b) by 937 days.

(21) Appl. No.: 12/475,722

(22) Filed: Jun. 1, 2009

(65) Prior Publication Data

US 2010/0000429 A1 Jan. 7, 2010

Related U.S. Application Data

(60) Provisional application No. 61/057,669, filed on May 30, 2008.

(51) Int. Cl.
*B41F 15/08* (2006.01)

(52) U.S. Cl.
CPC ..... *B41F 15/0863* (2013.01)

(58) Field of Classification Search
CPC ..... B41F 15/00; B41F 15/14; B41F 15/0863; B41F 15/16
USPC ..... 101/115, 123, 126
See application file for complete search history.

(56) References Cited

U.S. PATENT DOCUMENTS 3,795,189 A * 3/1974 Jaffa ..... 101/123
4,248,150 A * 2/1981 Lala ..... 101/123
4,735,139 A 4/1988 Szarka
4,819,559 A 4/1989 Szarka
4,909,146 A 3/1990 Szarka
4,939,991 A 7/1990 Szarka
5,063,842 A 11/1991 Clarke
5,129,155 A 7/1992 Hoffman et al.
5,195,434 A 3/1993 Hoffman
5,199,353 A 4/1993 Szyszko
5,216,820 A 6/1993 Green et al.
5,383,400 A 1/1995 Szyszko
D360,423 S 7/1995 Neal
5,456,172 A * 10/1995 Herrmann ..... 101/115
5,503,067 A 4/1996 Jaffa
5,575,206 A * 11/1996 Szyszko ..... 101/126
5,592,877 A 1/1997 Szyszko et al.
5,595,113 A 1/1997 Daniel et al.
5,607,243 A * 3/1997 Szarka ..... 101/126
5,640,905 A 6/1997 Szyszko et al.
5,649,479 A 7/1997 Hoffman
5,678,482 A 10/1997 Daniel et al.
5,787,805 A 8/1998 Szyszko et al.
5,809,877 A 9/1998 Szyszko et al.
5,845,569 A 12/1998 Tkacz et al.

(Continued)

FOREIGN PATENT DOCUMENTS

WO 0073071 A1 12/2000
WO 2001025011 A1 4/2001
WO 2009105693 A2 8/2009

*Primary Examiner* — David Banh
(74) *Attorney, Agent, or Firm* — Nixon Peabody LLP

(57) ABSTRACT

A screen printing apparatus has a base portion, and annular rail, an arm, and a first loading position. The base portion has a pair of opposing end sections separated by an intermediate section. The annular rail circumscribes a portion of the base portion. The arm radiates outwardly from the annular rail. The first loading position is located radially inwardly of the annular rail.

9 Claims, 9 Drawing Sheets

(56) References Cited

U.S. PATENT DOCUMENTS

| | | | | | |
|---|---|---|---|---|---|
| 5,881,641 | A | | 3/1999 | Tkacz | |
| 5,887,519 | A | * | 3/1999 | Zelko | 101/115 |
| 5,921,176 | A | | 7/1999 | Oleson | |
| 5,937,749 | A | * | 8/1999 | Ford | 101/115 |
| 5,943,953 | A | | 8/1999 | Oleson | |
| 5,953,987 | A | | 9/1999 | Oleson | |
| 6,012,387 | A | | 1/2000 | Hoffman, Jr. et al. | |
| 6,089,149 | A | * | 7/2000 | Zelko | 101/115 |
| 6,105,494 | A | | 8/2000 | Hoffman, Jr. et al. | |
| 6,112,654 | A | * | 9/2000 | Jaffa | 101/114 |
| 6,142,070 | A | | 11/2000 | Hoffman, Jr. et al. | |
| 6,161,304 | A | | 12/2000 | Iaccino et al. | |
| 6,276,274 | B1 | | 8/2001 | Hoffman, Jr. et al. | |
| 6,289,802 | B1 | * | 9/2001 | Zelko | 101/115 |
| 6,484,629 | B1 | | 11/2002 | Hoffman, Jr. et al. | |
| 6,910,419 | B2 | | 6/2005 | Oleson | |
| 2003/0121430 | A1 | * | 7/2003 | Eppinger | 101/126 |
| 2004/0000240 | A1 | * | 1/2004 | Oleson | 101/126 |
| 2005/0223918 | A1 | * | 10/2005 | Steffen et al. | 101/123 |
| 2005/0252394 | A1 | * | 11/2005 | Eppinger | 101/123 |
| 2006/0249039 | A1 | * | 11/2006 | Feldman et al. | 101/115 |
| 2006/0266232 | A1 | * | 11/2006 | Macchi | 101/115 |

* cited by examiner

MODULAR OVAL SCREEN PRINTING APPARATUS

CROSS-REFERENCE TO RELATED APPLICATIONS

This application claims the benefit of U.S. Provisional Application No. 61/057,669 filed on May 30, 2008, which is hereby incorporated by reference as if fully set forth herein.

FEDERALLY SPONSORED RESEARCH OR DEVELOPMENT

Not Applicable

TECHNICAL FIELD

The invention relates to printing systems. More particularly, the invention relates to a circumferential screen printing apparatus.

BACKGROUND OF THE INVENTION

Printed indicia which are applied to T-shirts and other articles of clothing have become very popular in the last decade. Boutiques which specialize in printing fanciful indicia such as ornamentation, slogans, college names, or sports team names on T-shirts and other clothing are commonly seen in shopping malls. The indicia available at these boutiques can be pre-printed on a substrate and applied to articles of clothing purchased by the consumer with a heated press by boutique operators, or can be applied directly to an article of clothing. The indicia can comprise either simple one-color block letters or elaborate multi-color illustrations.

In common use in the industry in printing objects such as substrates or articles of clothing is a multi-station, turret type, printing press. The printing press of this type has a plurality of flat beds or platens spaced along its perimeter. Corresponding to each of these beds is a series of stations where a part of the indicia is alternately printed and cured on the object, i.e., substrate or article, being printed. The number of stations employed depends on the number of colors to be printed on the object. Indicia can consist of up to ten colors or more.

Also in common use are single station printing machines. Single station machines require the operator to print one color at a time using one screen at a time. After one color is printed on an object, the screen is removed and another screen placed thereon to print another color. As with the multi-station press, the new screen must be perfectly aligned with the preceding screen such that the image remains in registration. This single-stage process is very time-consuming, especially if multiple colors are used.

The most critical and time-consuming part of the screen printing process involving multiple colors is the alignment or registration of successive screens. Each screen for each color must be in registration with the other screens to ensure that the various colors do not overlap or are incorrectly spaced. Otherwise, the printed indicia will not be in registration, resulting in a skewed or imperfect indicia.

SUMMARY OF THE INVENTION

A first aspect of the present invention is directed to a screen printing apparatus comprising a base portion, an annular rail, an arm, a plurality of stations, and a registration system. The base portion has a pair of opposing end sections separated by an intermediate section. The annular rail circumscribes a portion of the base portion. The plurality of stations are located about the periphery of the annular rail. The arm radiates outwardly from the annular rail and has a free first end and an opposing second end engaged with the annular rail. The registration system comprises a portion of the second end.

The registration system of the screen printing apparatus of the previous paragraph may comprise a portion of the arm engaging the annular rail along a pair of discreet points on the annular rail and an external alignment member selectively engageable with another portion of the arm.

The pair of discreet points of the screen printing apparatus of the previous paragraph may be horizontally spaced from each other, and the portion of the arm engageable with the external alignment member may be located between the two discreet points.

The external alignment member of the screen printing apparatus of any of the previous two paragraphs may be pivotal such that rotation of the alignment member about a pivot point causes the external alignment member to engage the arm.

The portion of the arm engaged by the external alignment member of the screen printing apparatus of any of the previous three paragraphs may comprise an arcuate cutout.

The arm of any of the screen printing apparatus of any of the previous four paragraphs may further comprise first and second pairs of rollers. Each pair of rollers may have a radially inner roller spaced from a radially outer roller. The annular rail may be located between the radially inner and radially outer rollers, and the two discreet points on the annular rail may be created by engagement between the radially inner rollers and a radially inner surface of the annular rail.

The screen printing apparatus of any of the previous six paragraphs may further comprise a lower annular rail positioned below the annular rail wherein a portion of the arm engages the lower annular rail.

The arm of the screen printing apparatus of the previous paragraph may further comprise a pair of lower rollers engaging a radially outer surface of the lower annular rail.

The screen printing apparatus of any of the previous eight paragraphs may further comprise a first loading position located radially inwardly of the annular rail.

The end portions of the screen printing apparatus of any of the previous nine paragraphs may be modular.

The intermediate portion of the screen printing apparatus of any of the previous ten paragraphs may be modular such that at least one additional intermediate section may be selectively inserted between the opposing end sections.

A second aspect of the present invention is directed to a screen printing apparatus comprising a base portion, an annular rail, an arm, and a first loading position. The base portion has a pair of opposing end sections separated by an intermediate section. The annular rail circumscribes a portion of the base portion. The arm radiates outwardly from the annular rail. The first loading position is located radially inwardly of the annular rail.

The base portion of the screen printing apparatus of the previous paragraph may include a void region wherein the first loading position is located.

The void region of the screen printing apparatus of the previous paragraph may be located between opposing frame members of the intermediate section.

The arm of the screen printing apparatus of any of the previous four paragraphs may comprise a free end and an opposing end in engagement with the annular rail.

The arm of the screen printing apparatus of any of the previous five paragraphs may traverse upon the annular rail.

The screen printing apparatus of any of the previous six paragraphs may further comprise a means for indexing the arm about the annular rail.

The annular rail of the screen printing apparatus of any of the previous seven paragraphs may be oval. The screen printing apparatus of any of the previous seven paragraphs may have a pair of arcuate ends separated by a pair of opposing linear segments.

The screen printing apparatus of any of the previous eight paragraphs may further comprise a registration system. The registration system may comprise a portion of the arm engaging the annular rail along a pair of discreet points on a radially inner surface of the annular rail and an external alignment member selectively engageable with a portion of the arm.

The pair of discreet points of the screen printing apparatus of the previous paragraph may be horizontally spaced from each other, and the portion of the arm engageable with the external alignment member may be located between the two discreet points.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which.

DETAILED DESCRIPTION

Figure 1:
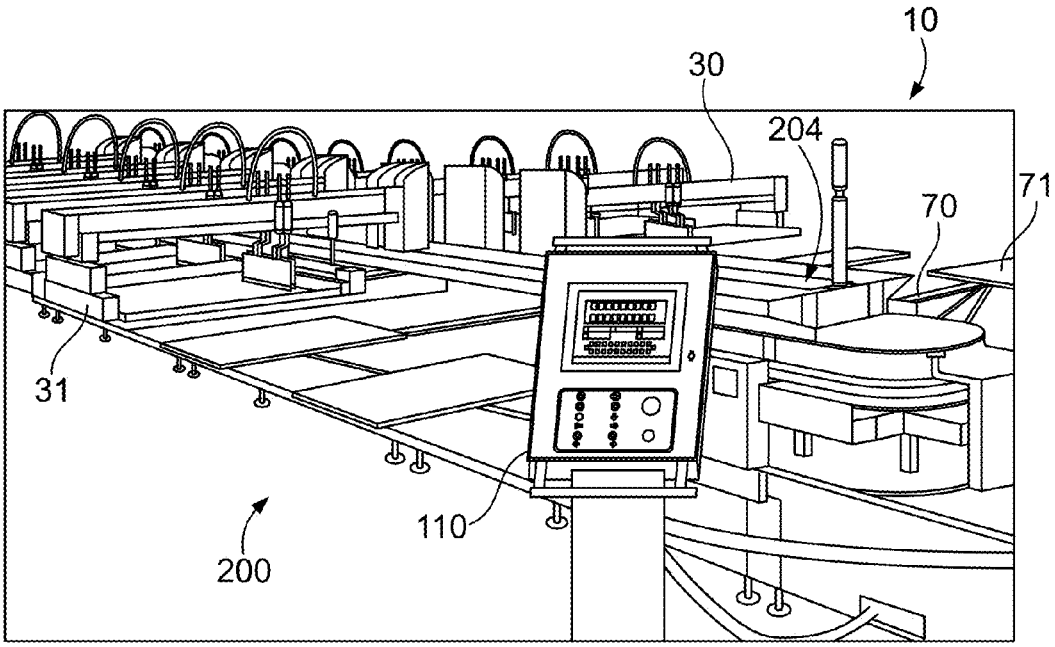
FIG. 1 is a perspective view of a modular, oval screen printing apparatus.
Figure 2:
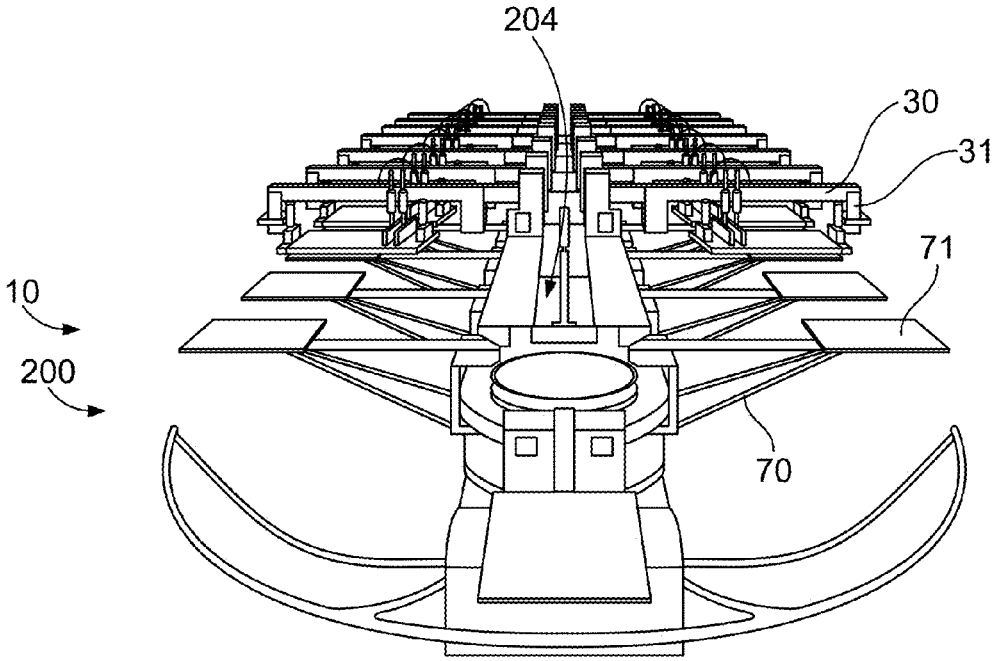
FIG. 2 is a front elevated view of the screen printing apparatus of FIG. 1.
Figure 3:
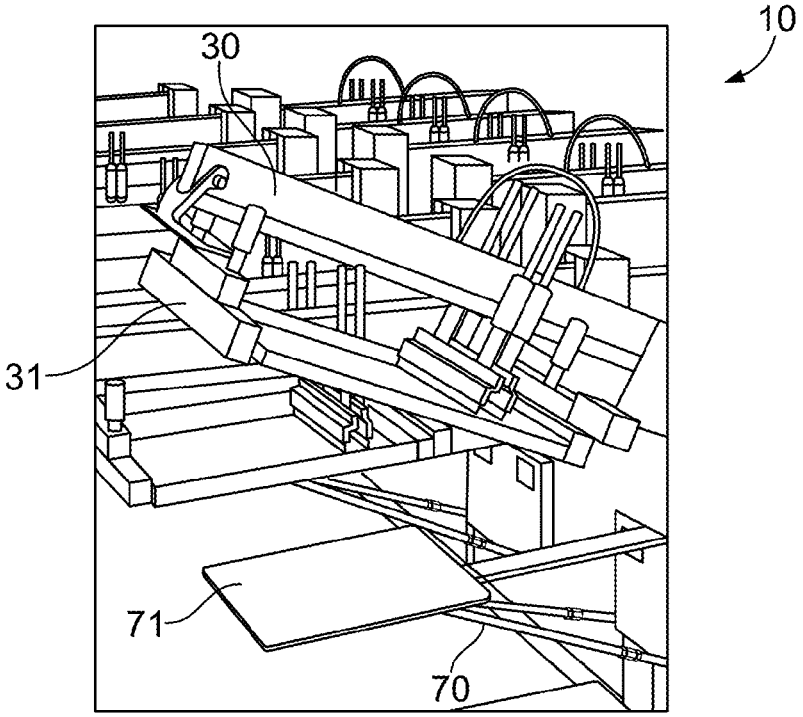
FIG. 3 is a partial perspective view of the screen printing apparatus of FIG. 1 showing a print head.
Figure 4:
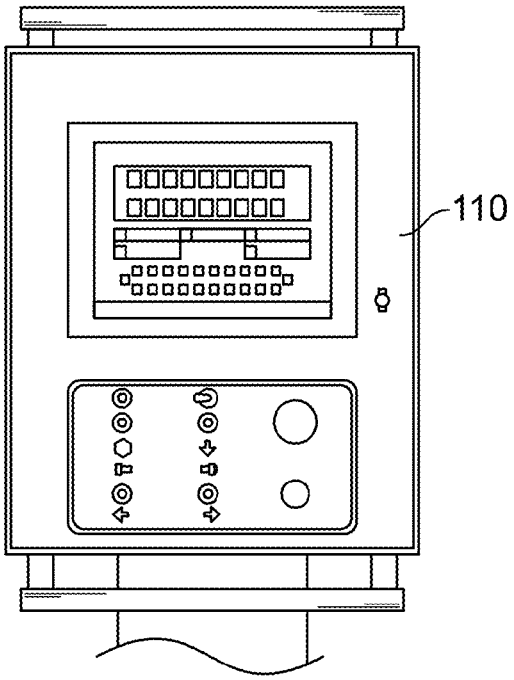
FIG. 4 is a control panel used in conjunction with the screen printing apparatus of FIG. 1.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

The present invention is directed to printing systems. The term "printing system" is used broadly to comprise any apparatus, article, or method, or sub-sets thereof, used in the transfer of images to a target article such as textiles, including clothing, towels, etc., luggage, backpacks, or any other article that one would wish to print an image thereon. These include ink jet printing apparatuses, screen printing apparatuses, manual screen printing apparatuses, and the support systems, such as pallets, used therewith alone or in combination.

Now referring to the FIGS., a screen printing apparatus 10 is illustrated. The screen printing apparatus 10 illustrated represents a improved circumferential, oval-shaped press. This apparatus is modular and expandable. It can be configured for almost any production requirement. Due to an oval footprint, this apparatus 10 takes up less floor space than comparable turret screen printing apparatuses. Thus, it makes more efficient use of available production area. The oval footprint also allows this apparatus 10 to be utilized at manufacturing locations (long, narrow rooms) where typical comparable turret screen printing apparatuses could not.

The apparatus 10 incorporates a sophisticated servo-drive indexing system that combines extremely high speed with smooth operation and precise control. It also incorporates multiple-indexing capability, which allows virtually unlimited load/unload scenarios. The apparatus 10 design allows a user to start with as many—or few—print heads as he/she needs, and add more as his/her needs change. Other than the end stations, there are no restrictions on print head placement. All other stations can support print heads—and any station can be left open.

This apparatus allows users to change the placement of load/unload stations for maximum efficiency.

The apparatus 10 leaves the front of the pallet and the pallet arm assembly free of obstruction, allowing them to easily handle almost any type of item. Hooded sweatshirts, pant legs, cut pieces, T-shirts, and most other types of textiles can be easily loaded and properly located on this apparatus 10, maximizing production and flexibility.

Figure 5:
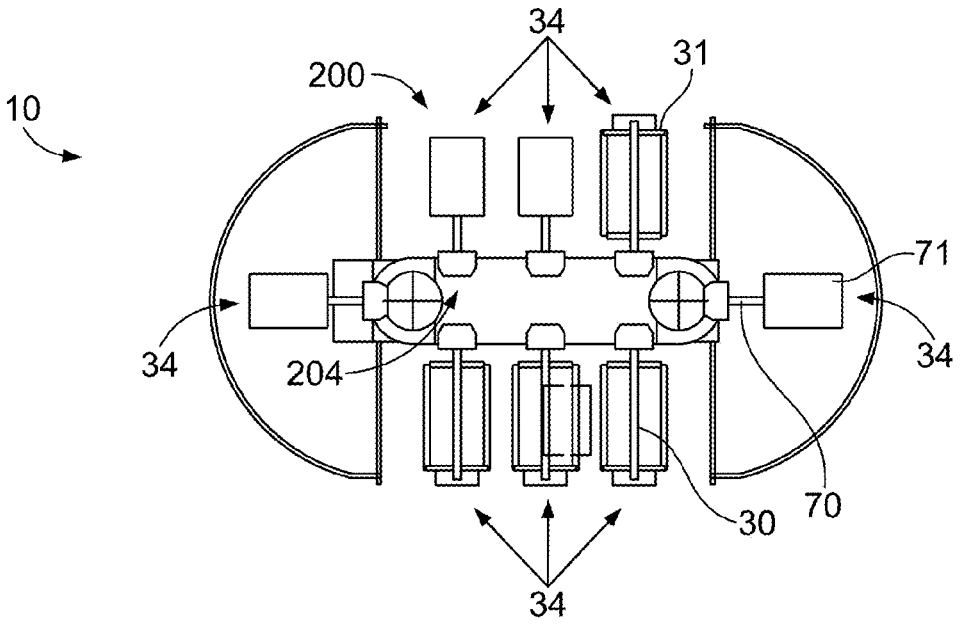
FIG. 5 is a top plan view of a modular, oval screen printing apparatus having 8 stations.
Figure 6:
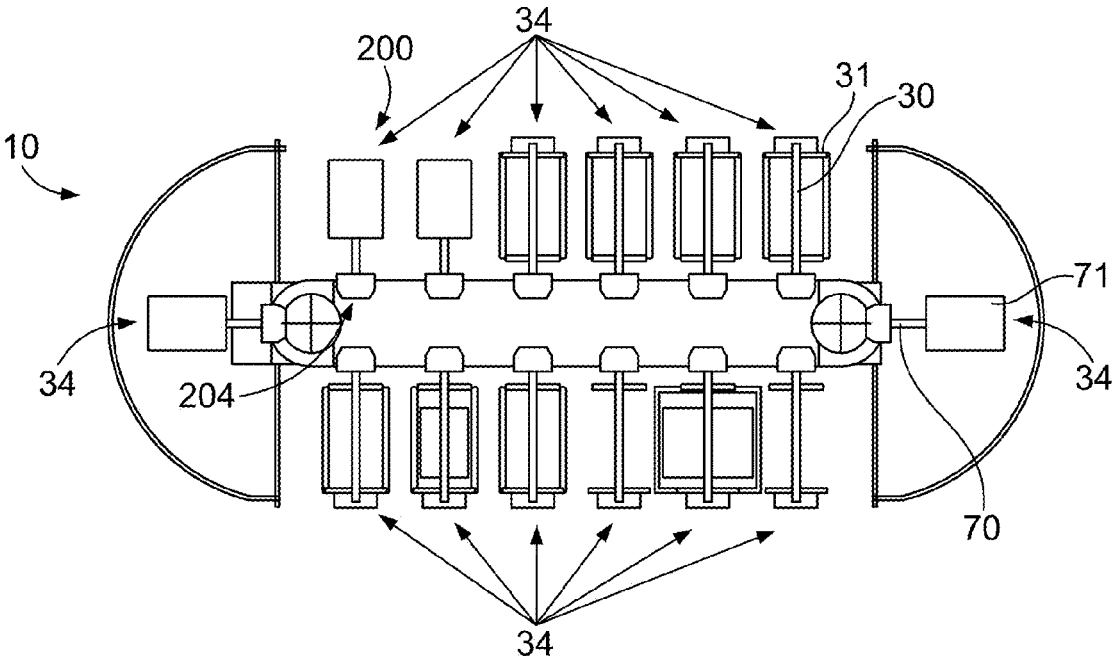
FIG. 6 is a top plan view of a modular, oval screen printing apparatus having 14 stations.
Figure 7:
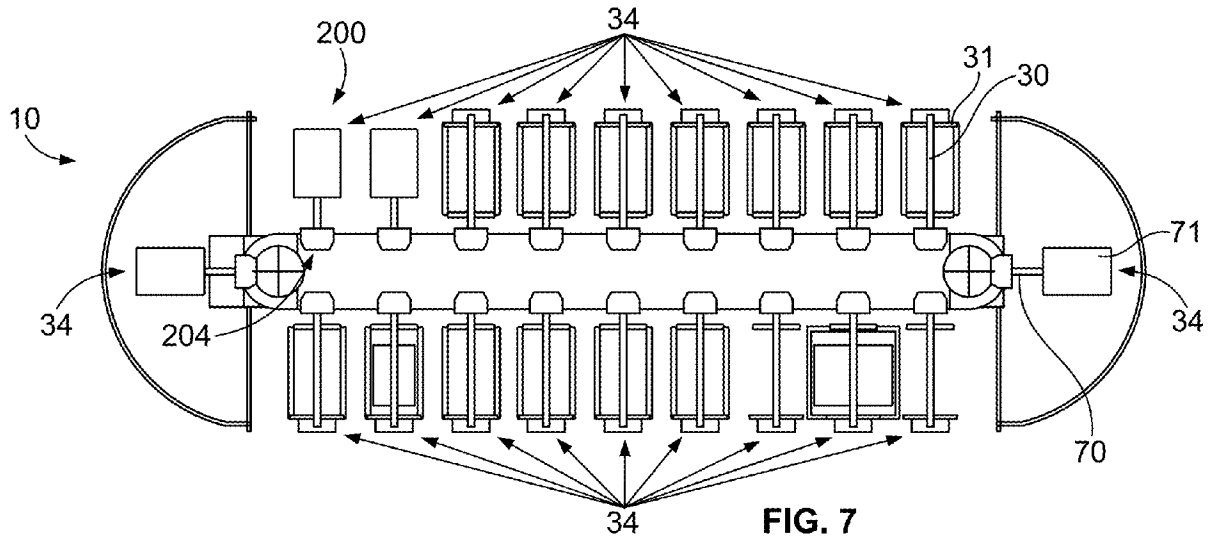
FIG. 7 is a top plan view of a modular, oval screen printing apparatus having 20 stations.
Figure 8:
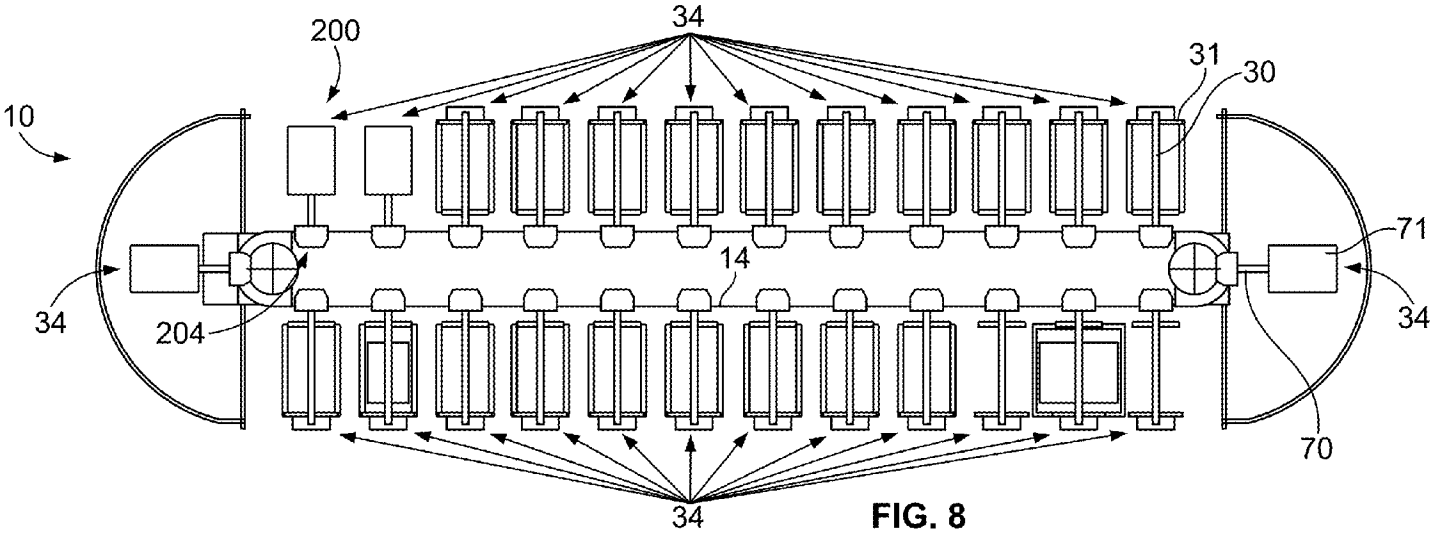
FIG. 8 is a top plan view of a modular, oval screen printing apparatus having 26 stations.
Figure 9:
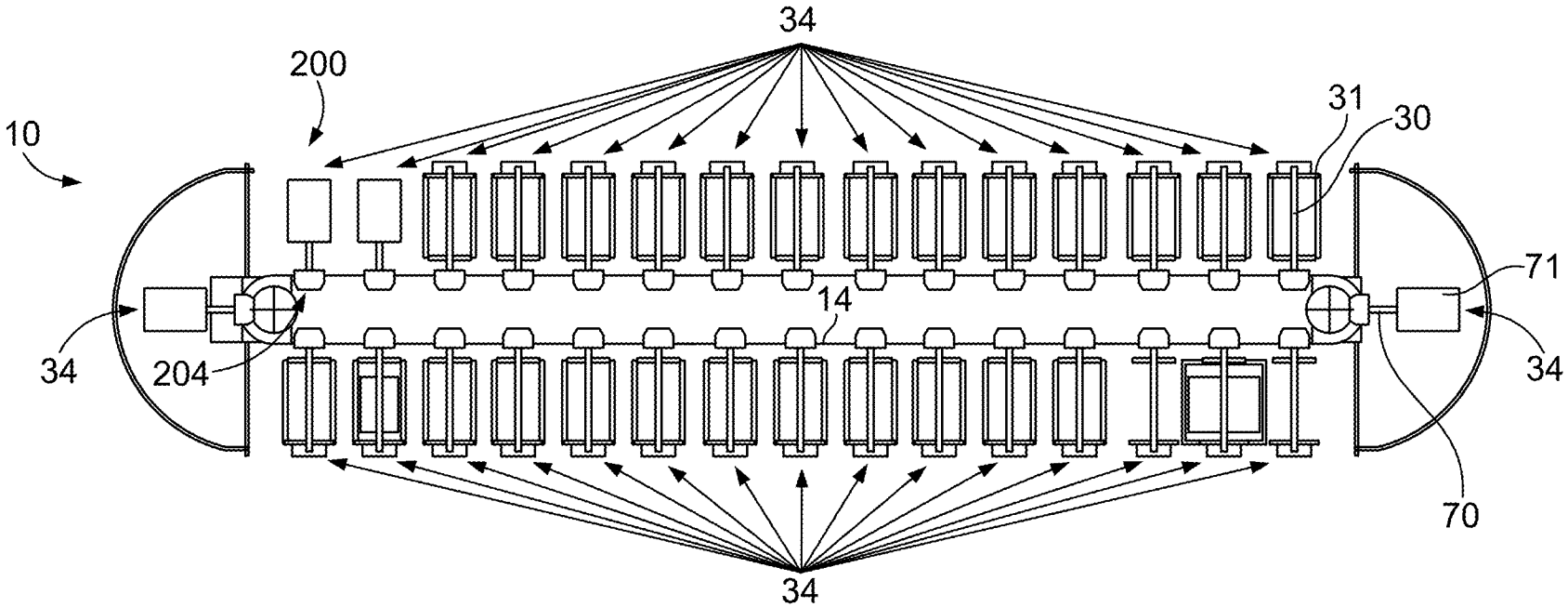
FIG. 9 is a top plan view of a modular, oval screen printing apparatus having 32 stations.
Figure 10:
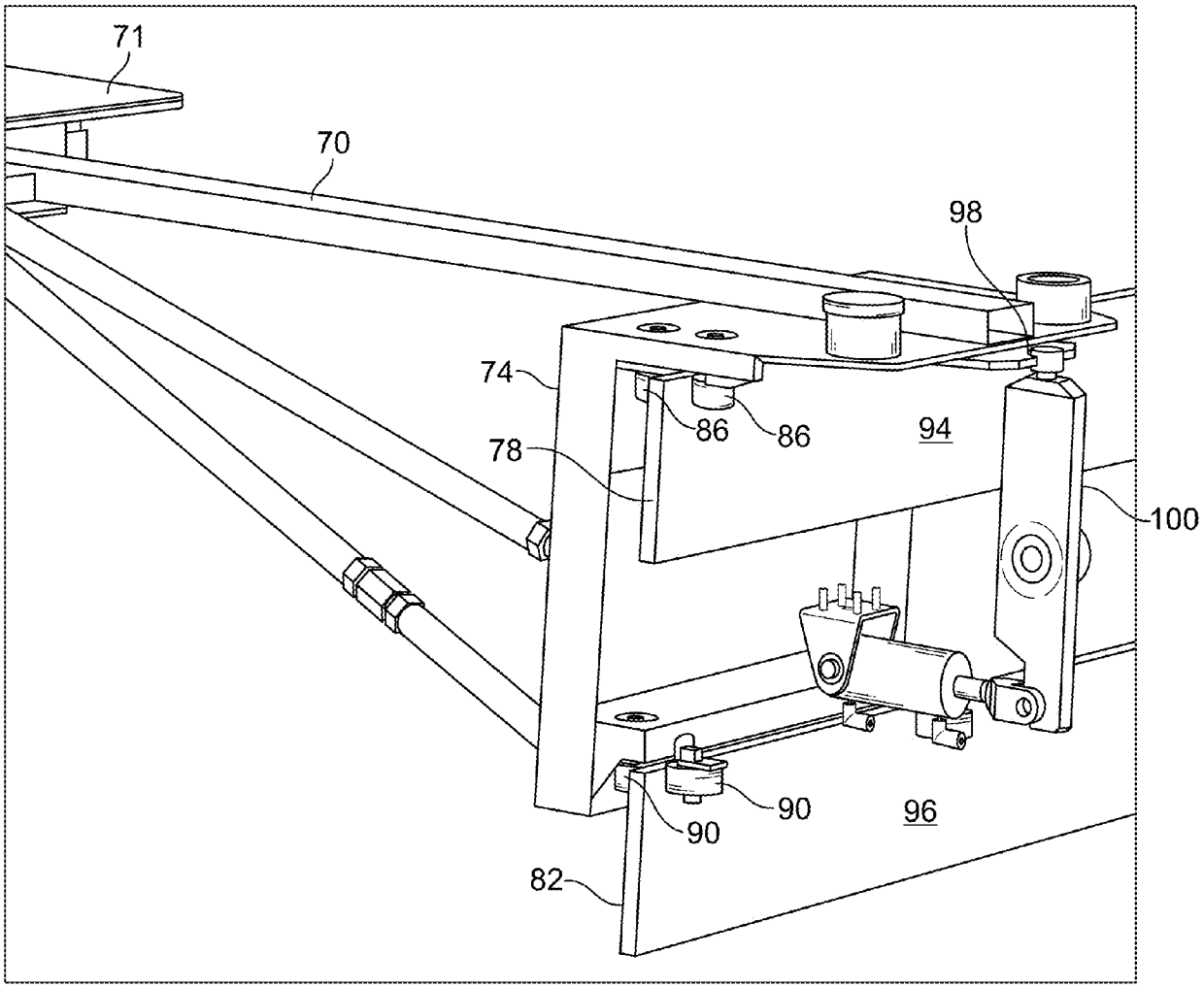
FIG. 10 is a rear perspective view of an arm for the screen printing apparatuses of the previous FIGS. showing a three point registration system.
Figure 11:
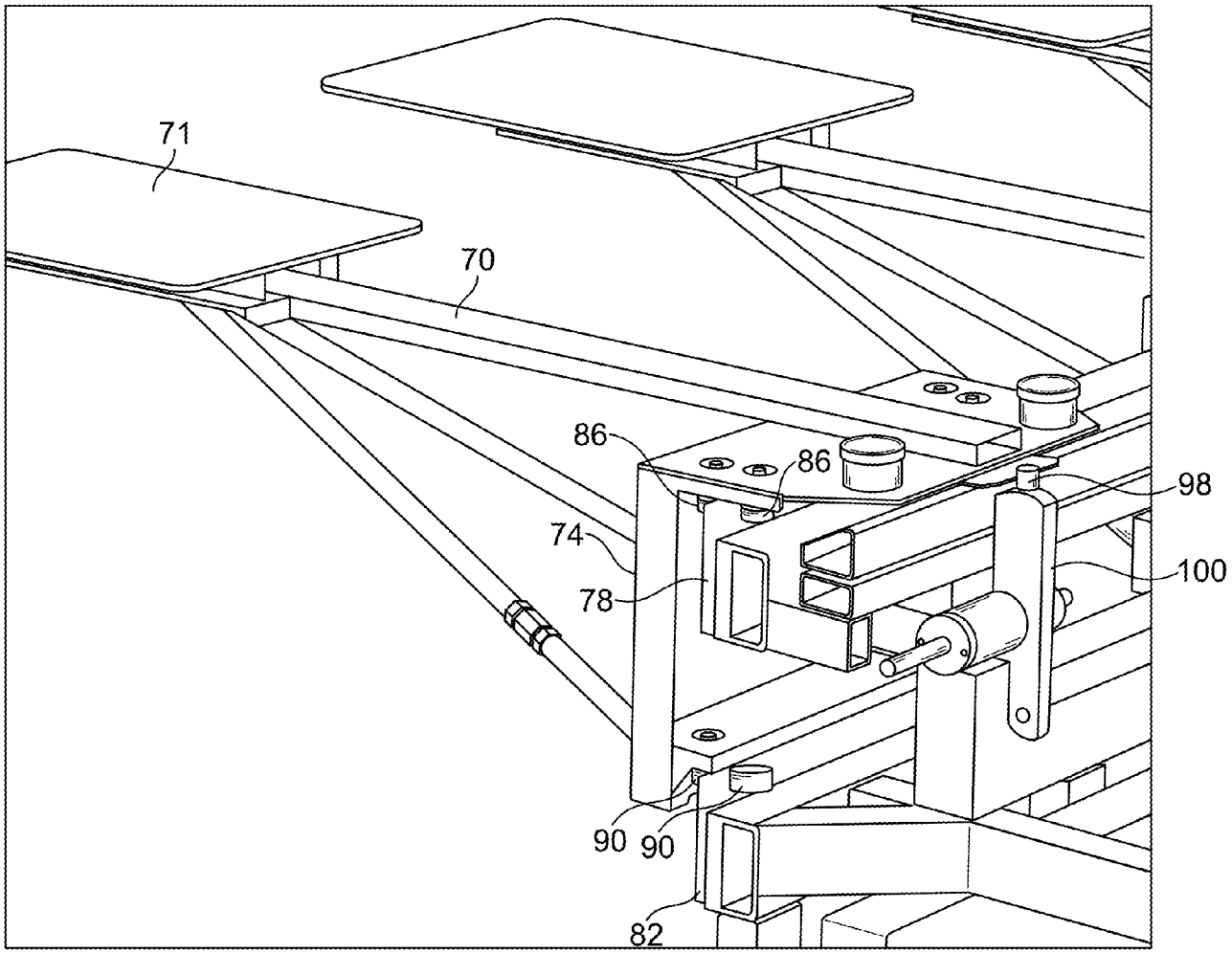
FIG. 11 is an alternate view of the arm of FIG. 10.
Figure 12:
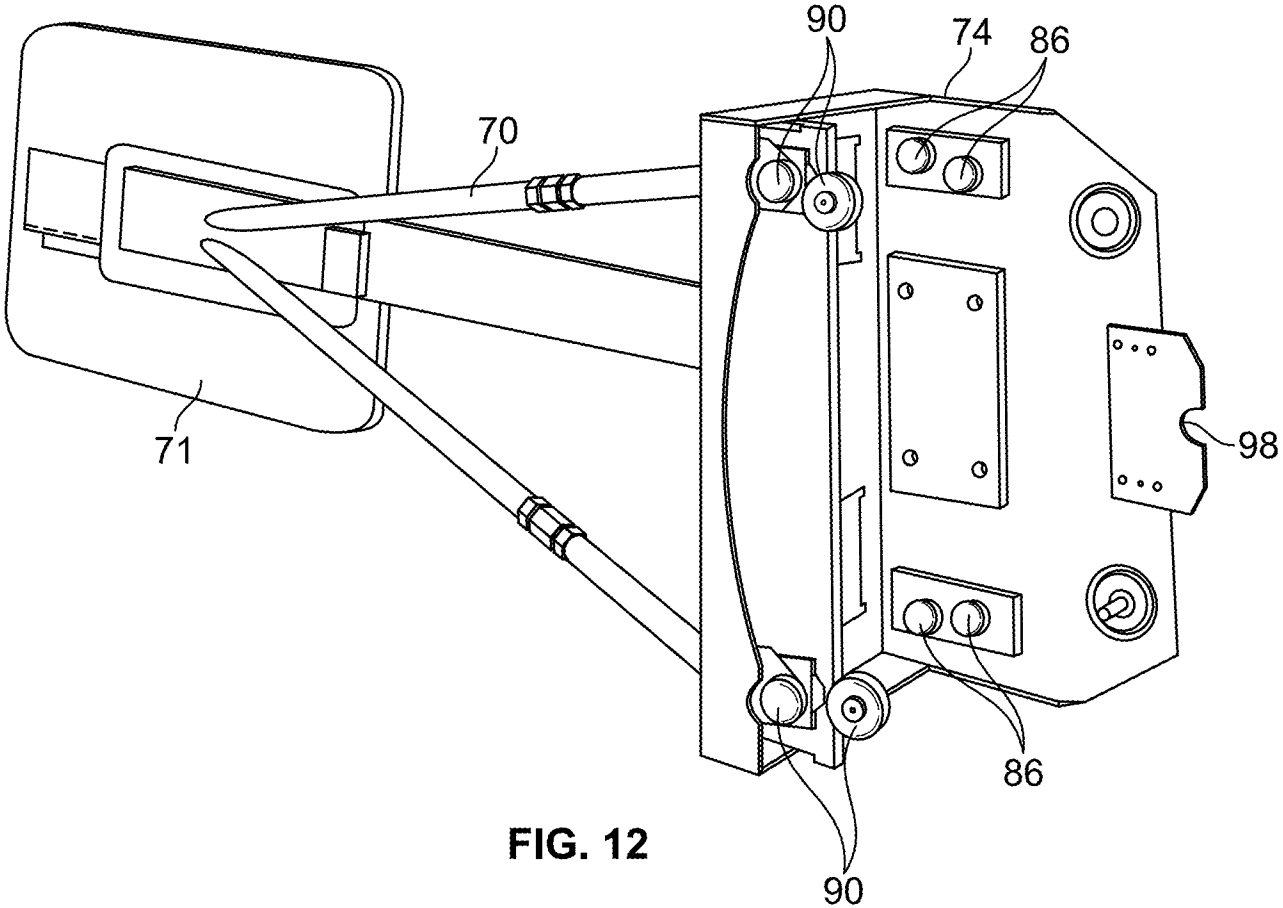
FIG. 12 is a bottom view of the arm of FIG. 10 detached from the screen printing apparatus.
Figure 13:
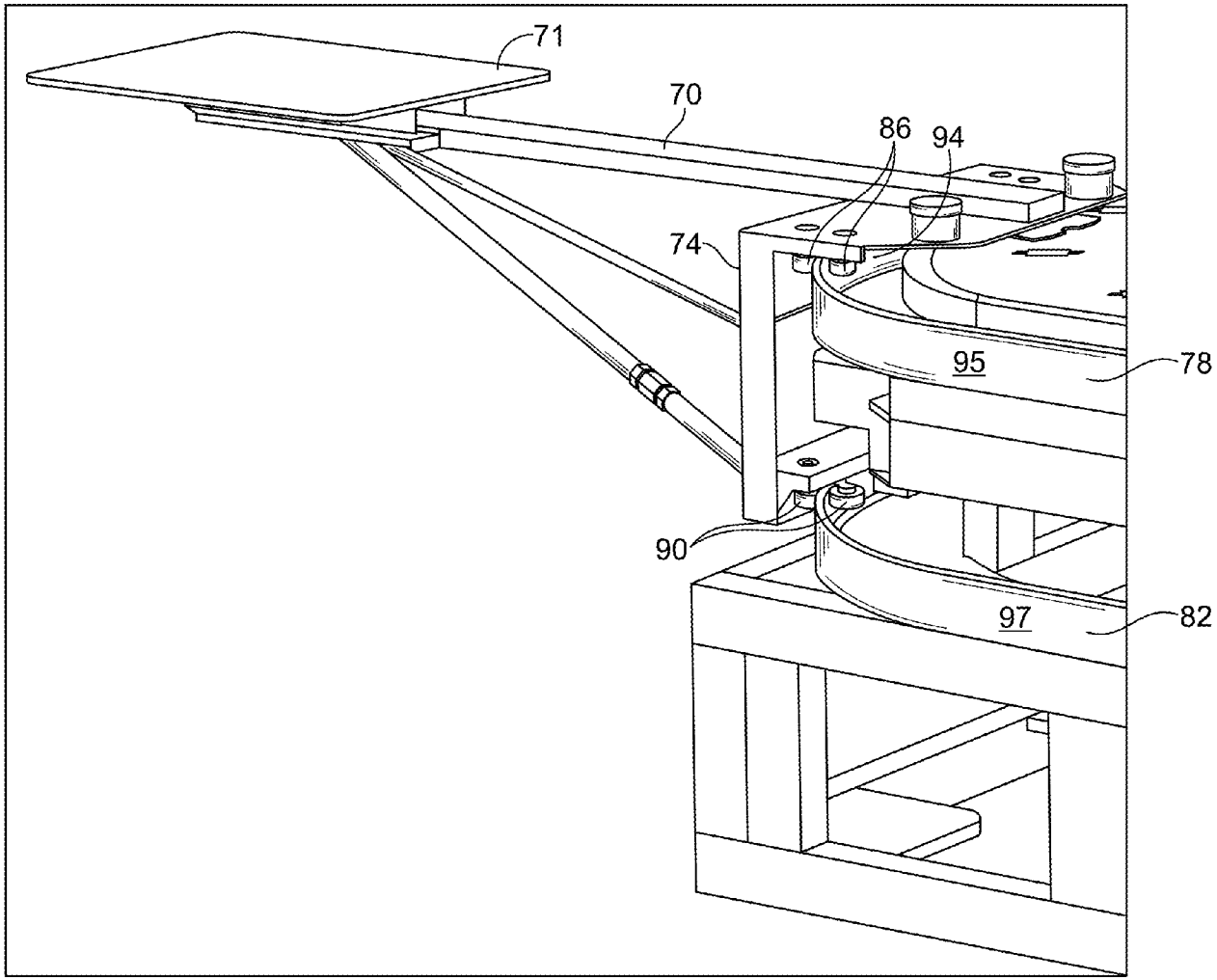
FIG. 13 is a perspective view of an arcuate end portion station.

In a basic configuration illustrated in FIG. 5, the apparatus 10 has a base section 14 supporting a plurality of spaced apart, spoke, upper and lower arms 30,70. In the embodiment shown, the distal ends of the lower arms 70 support metal pallets, flat beds, or platens 71 for carrying a target article, e.g., a textile, a rug, or other substrate (not shown), to be printed upon. The distal ends of the upper arms 30 support printing heads 31 or conventional, well-known curing units (not shown). A curing station or printing head 31 may be associated with each arm 30 in the linear portion of the apparatus 10. While the machine of the present invention is shown and described having upper arms 30 supporting printing heads 31 or curing units and the lower arms 70 supporting pallets 71, it is, of course possible for the upper arms 30 to support the pallets 71 and the lower arms to support the printing heads 31 or curing units.

The base section 14 comprising eight (8) stations 34. The apparatus 10, however, is modular, such that it can be expanded by adding linear modules 38, each having six (6) stations 34, between a pair of opposing arcuate modules 42, each having a single station 34. As shown in the FIGS., this modular design provides for virtually limitless expansion in six-station increments.

One of the sets of arms 30,70 rotates around the base section 14. In the embodiment shown, the lower arms 70 rotate relative to the upper arms 30. This base section 14 includes, among other things, the unit's 10 supporting feet and a support frame.

A typical printing head 31 includes a flood bar, a squeegee, and a screen (shown on a single printing head 31 supported by opposed arms 32. Relative movement between the flood bar and a target area, which may include the screen, a target article, and the pallet 71, causes the flood bar to bring paint or ink to the screen. Upon a relative movement by the squeegee and the target area, the ink is applied across the screen by the adjacent squeegee. Together, a print is formed on the textile.

As described above, these printing heads 31, or curing units, form stations 34. Eight (8) such stations are shown in FIG. 5. The pallet 71 with the textile thereon is rotated, indexed and registered at each station where the textile is processed, that being either printed upon or cured. Each arm 70 and pallet 71 rotates through the eight (8) stations 34. While it is appreciated the upper arms 30 can rotate relative to the lower arms 70 or the pallets 71 and printing heads 31 can be reversed, the present invention will be discussed with the stationary printing heads 31 attached to the upper arms 30 and the rotating pallets 71 attached to the lower arms 70.

Unlike most previous oval screen printing machines, the apparatus 10 of the present invention leaves a front, or radially outward, section of the pallet 71 and the pallet arm 71 free of obstruction, thus having a free end. This allows the apparatus 10 to be used to print almost any type of item, including hooded sweatshirts, pant legs, cut pieces, T-shirts, and most other types of textiles. These items can be easily loaded and properly located on the pallet 71, maximizing production and flexibility. As will be described below, a three-point leveling/registration system contributes to this advantage by making the free end of the pallet possible.

Opposite the pallets 71, the arms 60 include supports 74 which ride on upper and lower annular rails 78,82 provided on the base section 14. The rails 78,82 are preferably narrow strips of precisely machined steel, lying on a common vertical plane, in spaced, stacked relationship.

The supports 74 include a set of upper rollers 86 and a set of lower lowers 90. The upper rollers 86 are arranged in pairs such that a radially inner roller of the pair engages a radially inner surface 94 of the upper rail 78, and a radially outer roller of the pair engages a radially outer surface 95 of the upper rail 78.

The set of lower rollers 90 engage the lower rail 82. The set of lower rollers may or may not include radially inner rollers which engage a radially inner surface 96 of the lower rail 82. More importantly, radially outer rollers of the set of lower rollers 90 engage a radially outer surface 97 of the lower rail 82.

The support 74 further includes a receiver 98. The receiver is preferably constructed from a steel plate mounted on a horizontal plane and includes an arcuate cutout. The cutout is adapted, as in sized, shaped, and positioned, to receive an end portion of a pivoting alignment member 100 mounted to the base section 14.

Each pallet 71 achieves precise alignment and registration at a given station 34 by way of the structure described above. For example, when an arm 71 arrives at a station 34 the alignment member 100 pivots counterclockwise about a pivot point such that the end portion of the alignment member 100 rotates into the receiver 98 providing a significantly high force against the support 74. The force is great enough to transfer to the radially inner upper rollers 86 which are pinned against the radially inner surface 94 of the annular rail 78 at two discreet points defined by the inner rollers. This registration system provides a precise three-point leveling system with exceptional accuracy. In addition, the radially outer rollers of the lower set of rollers 90, by contacting the radially outer surface 97 of the lower rail 82, provide resistance against the downward force of the print head 31 against the pallet 71 at the free ends of the arms 70 during printing, which resists/prevents downward deflection of the pallet 71 potentially caused by the printing process.

Another advantage provided by the present apparatus 10 is related to loading and unloading garments on the pallets 71. With previous screen printing apparatuses of this type, all loading and unloading of the target articles must be accomplished from a radially outer loading position 200 which is a radially outer location relative to the traversing pallets 71. The present apparatus 10 provides an additional radially inner loading position 204 which is located within the bounds of the base section 14 at a radially a inner location relative to the traversing pallets 71 and radially inwardly of the upper rail 78 within a void region between frame members of an intermediate module. The inner loading position 204 is made possible by a combination of a chain driven indexing system which rotates about the center of the base section 14, freeing an enlarged center section or void region which creates the inner loading position 204.

The inner loading position 204 is advantageous because it allows a user to be positioned at the radially inner edge of the pallets 71 to load a target article at the radially inner portion of the pallet 71 while a second user positioned at the radially outer loading position 200 loads a separate, second target article on the radially outer portion of the same pallet 71. In other words, two users can two separate articles on the same pallet 71 such that the capacity of the machine is doubled when printing smaller articles that can be placed two articles to a single pallet 71.

A digital touch-screen control panel 110 is provided for controlling operation of the apparatus 10. The control panel 110 has icon-based labeling which can display information and commands in numerous languages, simplifying press operation and training. The control panel 110 includes a digital touch-screen control with icon-based labeling can display information and commands in numerous languages, simplifying press operation and training anywhere in the world. From the control panel 110 an independent print-start/print-finish setting can automatically activate and stop print heads 31 at the beginning and end of production runs. The control panel 110 further includes jog-left/jog-right controls, control for multiple (1-9) print stroke capability. A production speed monitor ensures more accurate job costing. A test print setting turns individual print heads 31 on/off during test print cycle. The control panel 110 may be pedestal-mounted for versatile control.

The apparatus 10 incorporates a servo-drive indexing system that combines extremely high speed with smooth operation and precise control. Other than the end stations, there are no restrictions on print head placement. All other stations can support print heads 31, and any station 34 can be left open. The apparatus 10 also allows users to change the placement of load/unload stations for maximum efficiency.

As used herein, the terms "first," "second," "third," etc. are for illustrative purposes only and are not intended to limit the embodiments in any way. Additionally, the term "plurality" as used herein is intended to indicate any number greater than one, either disjunctively or conjunctively as necessary, up to an infinite number. The terms "joined," 'attached," and/or "connected" as used herein are intended to put or bring two elements together so as to form a unit, and any number of elements, devices, fasteners, etc. may be provided between the joined, attached or connected elements unless otherwise specified by the use of the term "directly" and/or supported by the drawings. The term "annular" is intended to encompass any ring-like shape, including those with minor interruptions or voids that would not adversely affect the indexing of the arms about the rail.

While the specific embodiments have been illustrated and described, numerous modifications come to mind without significantly departing from the spirit of the invention, and the scope of protection is only limited by the scope of the accompanying Claims.

What is claimed is:

1. A screen printing apparatus comprising:

a base portion having a pair of opposing end sections separated by an intermediate section;

a first annular rail having a first inner surface and a first outer surface circumscribing a portion of the base portion;

a second annular rail having a portion in vertical spaced relationship with the first annular rail and having a second inner surface and a second outer surface;

a plurality of stations located about the periphery of the first annular rail;

a support having a first roller and a second roller and a receiver, the first roller engaging a surface of the first annular rail and the second roller engaging a surface of the second annular rail;

an arm radiating outwardly from the support, the arm having a free first end and an opposing second end connected to the support; and a pivoting alignment member proximal a station and moveable from a first position engaging the receiver to a second position not engaging the receiver, when in the first position the pivoting member applies a force radially outwardly from the pivoting alignment member to lock the first roller against a surface of the first rail.

2. The screen printing apparatus of claim 1 wherein the first roller comprises a first pair of rollers engaging the first inner surface and spaced from one another with the receiver being between the first pair of rollers.

3. The screen printing apparatus of claim 2 wherein the first pair or rollers engage the first inner surface.

4. The screen printing apparatus of claim 3 wherein the receiver comprises a cutout.

5. The screen printing apparatus of claim 4 wherein the first roller further comprises a second pair of rollers engaging the first outer surface.

6. The screen printing apparatus of claim 5 wherein the second roller comprises a third pair of rollers spaced from one another and engaging the second outer surface.

7. The screen printing apparatus of claim 6 wherein the second roller comprises a fourth pair or rollers engaging the second inner surface.

8. The screen printing apparatus of claim 1 further comprising:

a first loading position located radially inwardly of the first annular rail.

9. The screen printing apparatus of claim 1 wherein the end sections and the intermediate section of the base portion are modular such that at least one additional intermediate section may be selectively inserted between the opposing end sections.

* * * * *